US011178944B2

(12) United States Patent
Lachyani Abiri et al.

(10) Patent No.: US 11,178,944 B2
(45) Date of Patent: Nov. 23, 2021

(54) SAFE RING

(71) Applicant: EL SOL LLC, Tel Aviv (IL)

(72) Inventors: Raz Lachyani Abiri, Pardes Hana (IL); Osnat Lachyani Abiri, Pardes Hana (IL)

(73) Assignee: EL SOL LLC, Tel Aviv (IL)

( * ) Notice: Subject to any disclaimer, the term of this patent is extended or adjusted under 35 U.S.C. 154(b) by 0 days.

(21) Appl. No.: 17/225,381

(22) Filed: Apr. 8, 2021

(65) Prior Publication Data

US 2021/0219674 A1 Jul. 22, 2021

Related U.S. Application Data

(63) Continuation-in-part of application No. PCT/IL2020/051093, filed on Oct. 12, 2020.

(60) Provisional application No. 62/937,349, filed on Nov. 19, 2019.

(51) Int. Cl.
*A44C 9/00* (2006.01)

(52) U.S. Cl.
CPC ..... *A44C 9/0038* (2013.01)

(58) Field of Classification Search
CPC ... A44C 9/0038; A44C 9/0023; A44C 9/0046; A44C 5/04; A44C 9/00; A44C 9/0007; A44C 9/0015
See application file for complete search history.

(56) References Cited

U.S. PATENT DOCUMENTS

| | | | | |
|---|---|---|---|---|
| 6,370,913 | B1 * | 4/2002 | Voeltzel | A44C 9/0038 63/15 |
| 10,702,029 | B2 * | 7/2020 | Herz | A44C 5/0053 |
| 10,932,533 | B1 * | 3/2021 | Goodwin | A44C 9/0015 |
| 2019/0166962 | A1 * | 6/2019 | Stephens | A44C 9/0038 |
| 2019/0313749 | A1 * | 10/2019 | Goodwin | B29C 45/263 |
| 2020/0077752 | A1 * | 3/2020 | Junkins | A44C 9/0038 |
| 2020/0390203 | A1 * | 12/2020 | Sana | A44C 9/02 |

FOREIGN PATENT DOCUMENTS

| | | | |
|---|---|---|---|
| CN | 209017945 | U | 6/2019 |
| DE | 10334712 | A1 | 2/2005 |
| WO | 2019073306 | A2 | 4/2019 |

OTHER PUBLICATIONS

PCT Search Report of International Application No. PCT/IL2020/051093 dated Feb. 8, 2021, 2 pp.

* cited by examiner

*Primary Examiner* — Jack W Lavinder
(74) *Attorney, Agent, or Firm* — The Roy Gross Law Firm, LLC; Roy Gross

(57) ABSTRACT

A safe ring is disclosed. The safe ring may include, a primary ring, having one or more weak spots, made from a material having an ultimate tensile strength higher than 60 MPa, and a secondary ring being at least partially encompassed by the primary ring, wherein a circumference of the ring is configured to expand under an application of an external pull force.

22 Claims, 7 Drawing Sheets

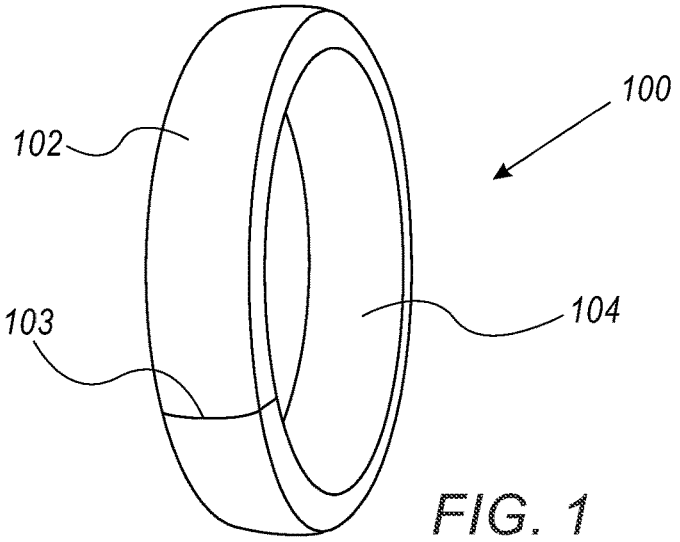
FIG. 1
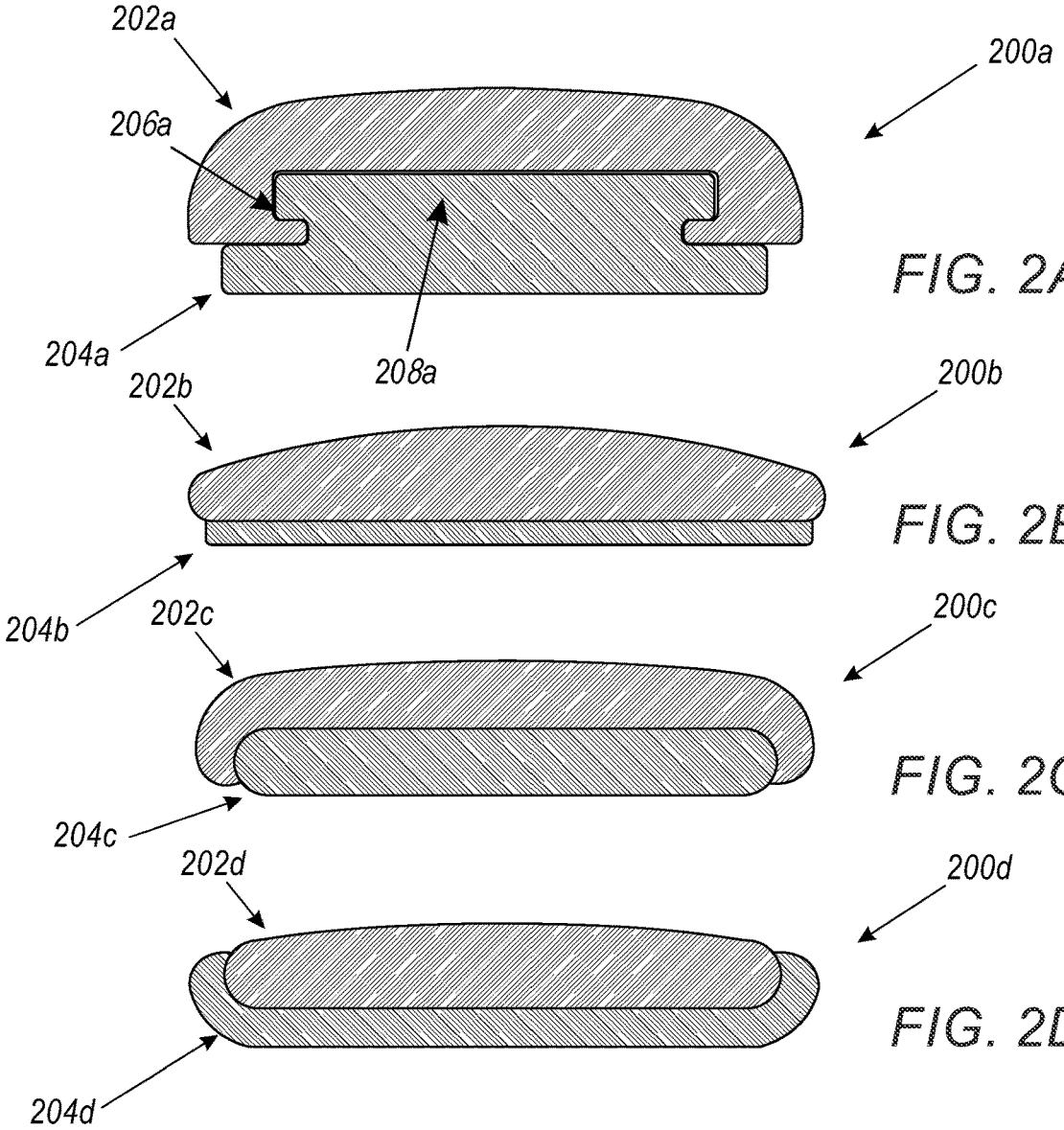
FIG. 2A
FIG. 2B
FIG. 2C
FIG. 2D

SAFE RING

CROSS-REFERENCE TO RELATED APPLICATIONS

This application is a Continuation-in-Part (CIP) of PCT International Application No. PCT/IL2020/051093, having an International Filing Date of Oct. 12, 2020, and claiming the benefit of priority of U.S. Provisional Patent Application No. 62/937,349, filed Nov. 19, 2019. Both applications are hereby incorporated by reference in their entirety.

FIELD OF THE INVENTION

The present invention relates to structure of rings. More particularly, the present invention relates to structure of safe rings.

BACKGROUND OF THE INVENTION

Rings are typically worn to symbolize a significant occasion, such as wedding, engagement, commitment, graduation of a certain institute or any other reason, or simply worn for ornamental purposes.

Injuries to fingers from rings can be serious, sometimes even leading to a loss of a finger.

Another problem associated with metal rings, and other pieces of jewelry, such as bracelets, is skin irritation, typically caused by allergies, commonly to the nickel component of the ring itself.

There is thus a need for safer rings and other types of jewelry.

SUMMARY OF THE INVENTION

Aspects of the disclosure, according to some embodiments thereof, relate to a safe ring, having for example, a layered ring structure, that may include a primary ring (e.g., an outer layer ring) and a secondary ring (e.g., an inner ring layer). A safe ring according to some embodiments of the invention may include, a primary ring made from a material having an ultimate tensile strength higher than 60 MPa, the primary may have one or more weak spots and a secondary ring being at least partially encompassed by the primary ring. In some embodiments, a circumference of the ring is configured to expand under an application of an external pull force.

In some embodiments, the ring is configured to fully encompass a circumference of a finger.

In some embodiments, the secondary ring may be made from a tearable material, selected such that the secondary ring is configured to be torn under the external pull force of at least 20 Newton. In some embodiments, the tearable material may include at least one of: polymers (e.g., elastomers), a natural fabric, a natural material such as leather, wood, a synthetic fabric and silicone. In some embodiments, the tearable material may be at least one of: a non-allergenic material, a heat insulating material, and an electricity insulating material.

Alternatively, the secondary ring may include one or more weak spots that are configured to be torn under the external pull force.

Alternatively, the secondary ring is made from an extendable material, selected such that the secondary ring is configured to extend under an external pull force of at least 10 Newton. In some embodiments, the extendable material comprises at least one of: polymers (e.g., elastomers), a natural fabric, a natural material such as leather, a synthetic fabric and silicone. In some embodiments, the extendable material is at least one of: a non-allergenic material, a heat insulating material, and an electricity insulating material.

In some embodiments, the secondary ring may be configured to encompass at least a portion of a circumference of a finger. In some embodiments, the primary ring may extend over edges of the secondary ring. In some embodiments, the primary and secondary ring may be mechanically connected to each other. In some embodiments, edges of the primary ring may at least partially penetrate edges of the secondary ring. In some embodiments, the secondary ring extends over edges of the primary ring. In some embodiments, edges of the secondary ring at least partially penetrate edges of the primary ring. In some embodiments, the secondary ring may have a cross section of 0.1-50 mm2. In some embodiments, the secondary ring may fully coat the primary ring.

In some embodiments, the primary ring may be an open ring having at least two free ends, where a gap between at least two free ends defines a weak spot. In some embodiments, the gap may be filled with an additional material. In some embodiments, the primary ring includes two or more separate sections, such that, each weak spot is defined by a connection between two separate sections. In some embodiments, the one or more weak spots may have a cross section smaller in at least one dimension, than cross sections in other portions of the primary ring. In some embodiments, the primary ring may include at least two portions each of the at least two portions may be made from at least one different material and wherein a connection area between each two portions creates a weak spot. In some embodiments, the one or more weak spots comprises one or more of: slots, cuts, grooves, cavities, conduits, openings, gaps and any combination thereof.

In some embodiments, the one or more weak spots may include at least two ends of the primary ring and the ring may include at least one component configured to limit relative movement of the at least two ends with respect to each other. In some embodiments, the at least one component is one or more connectors configured to connect at least two ends of the primary ring to limit relative movement of the at least two ends with respect to each other. In some embodiments, the one or more connectors may be configured to limit (e.g., prevent) relative movement of the at least two ends in at least two perpendicular axes. In some embodiments, the one or more connectors may be configured to limit relative movement of the at least two ends in three perpendicular axes. In some embodiments, the at least one component is the primary ring having at least Shore-A 60 hardness.

In some embodiments, the primary ring material may include at least one of, a metal, metal alloy, wood, ceramics, glass, resin, carbon fiber, stone, marble, and composite material. In some embodiments, the primary ring may have a cross section of 0.5-100 mm2.

Some additional aspects of the invention may be directed to a safe ring (e.g., a single ring). The ring may include one or more weak spots at which the ring may be configured to be broken under an application of an external pull force of at least 20 Newton. In some embodiments, the ring may be made from a material having an ultimate tensile strength higher than 60 MPa.

In some embodiments, the ring may be configured to fully encompass a circumference of a finger. In some embodiments, the ring may include two or more separate sections, each may be made from the material having an ultimate tensile strength higher than 60 MPa such that each weak spot is defined by an opening between the two or more separate sections filled with an additional material.

In some embodiments, the one or more weak spots may have a cross section smaller in at least one dimension, than cross sections in other portions of the ring. In some embodiments, the ring may include at least two portions made from at least two different materials and wherein a connection area between each two portions creates a weak spot. In some embodiments, the one or more weak spots comprises one or more of: slots, cuts, grooves, cavities, conduits, gaps, openings, connections, connection areas, and any combination thereof.

In some embodiments, the ring may be made from at least one of, a metal, metal alloy, wood, ceramics, glass, resin, carbon fiber, stone, marble, and composite material. In some embodiments, the ring (e.g., the single ring) may have a cross section of 0.5-100 mm2.

In some embodiments, the secondary ring may be a full ring. In some embodiments, the secondary ring may be made from a material having at least Shore-A 60 hardness. In some embodiments, the primary ring may include at least two portions.

According to an aspect of some embodiments, there is provided a safe ring comprising: an inner ring layer (also referred to herein as a secondary ring) made of an elastic material (the inner ring layer may be a single piece, fully closed, inner layer or may be composed of more than one section), the inner surface (for example, the entire inner surface) of said inner ring layer is configured to contact a finger on which the ring is worn by encompassing the circumference of the finger; and an outer layer (also referred herein as primary ring), made of a rigid material, attached to said inner ring layer, the outer layer comprises one or more "weak spots" and/or one or more slots, wherein said one or more slots extend from an outer surface of said outer layer through the thickness of said outer layer to an inner surface of said outer layer, wherein when an external pull force is applied to the ring, said outer layer is configured to bend, or break or separate into sections, thus maintaining the integrity of the finger. According to some embodiments, when the external pull force is applied to the ring, the inner ring layer stretches but remains intact. According to other embodiments, when the external pull force is applied to the ring, the inner ring layer is torn. According to other embodiments, when the external pull force is applied to the ring, the inner ring layer opens-up (when the inner ring layer includes more than one section).

According to some embodiments, said one or more "weak spots" may include areas having smaller width than other areas of said outer layer. According to some embodiments, said one or more "weak spots" may include areas having smaller thickness than other areas of said outer layer. According to some embodiments, said one or more "weak spots" may include one or more grooves in said outer layer. According to some embodiments, said one or more grooves may extend from a first edge of said outer layer to a second edge of said outer layer. According to some embodiments, the one or more grooves may extend from an outer surface of said outer layer through about 1%-99% (for example, about 1-20%, 5-30%, 10-50%, etc.) of the width of said outer layer.

According to some embodiments, the ring may include two or more slots or cuts, each extends from a first edge of said outer layer to a second edge of said outer layer, wherein the two or more slots or cuts divide the outer layer into two or more separate sections, each section attached to said inner ring layer. According to some embodiments, each of said two or more separate sections may be immobilized with respect to said inner ring layer.

According to some embodiments, the one or more "weak spots" and/or one or more slots or cuts, independently, may be in a shape of straight lines, curved lines (softer than straight lines), diagonal lines, zigzag lines (combination of diagonal lines that connect at points), continuous lines, dashed lines, dotted lines, or any combination thereof.

According to some embodiments, the outer ring (e.g., the primary ring) is a non-fully closed ring, wherein the length of the "missing" section/sections is up to about 70% (e.g., about, 2-5%, 5-10%, 10-30%, 20-50% etc.) of the circumference of non-fully closed ring.

According to some embodiments, the outer ring (e.g., the primary ring) may be a non-fully closed ring, wherein the separate outer ring sections contact one another with essentially no gap between them.

According to some embodiments, the one or more slots may be filled or not with another material.

According to some embodiments, the inner ring and the outer ring layer may be immobilized with respect to one another.

According to some embodiments, a ring may include two or more ring sections connected to each other by adhesive members thereby forming a ring, said adhesive members may function as "weak spots", wherein when an external pull force is applied to the ring, the adhesive members are configured to stretch bend, or break thus maintaining the integrity of the finger.

According to some embodiments, there is further provided herein a ring comprising: a single piece, fully closed, inner ring layer made of a non-allergenic elastic material, the entire inner surface of said inner ring layer may be configured to contact a finger on which the ring is worn by encompassing the circumference of the finger; and an outer layer, made of a rigid material, attached to said inner ring layer, wherein the inner ring layer may be positioned with respect to the outer layer, such that when a subject is wearing the ring, the outer layer (e.g., the primary ring) does not contact the skin of the subject's finger on which the ring is worn. The non-allergenic material may be or include silicone. According to some embodiments, when the ring is worn, the outer layer does not contact the skin of the adjacent finger/fingers. According to some embodiments, the inner ring layer covers essentially the entire inner surface of the outer layer.

According to some embodiments, the inner ring layer may extend over the edges of the outer layer.

According to some embodiments, the inner ring layer (made of elastic material, for example, a non-allergenic elastic material) may essentially entirely encompasses the outer ring layer (e.g., made of a rigid material), such that the ring comprises the elastic material on the outside and the rigid material on the inside.

Certain embodiments of the present disclosure may include some, all, or none of the above advantages. One or more other technical advantages may be readily apparent to those skilled in the art from the figures, descriptions, and claims included herein. Moreover, while specific advantages have been enumerated above, various embodiments may include all, some, or none of the enumerated advantages.

Unless otherwise defined, all technical and scientific terms used herein have the same meaning as commonly understood by one of ordinary skill in the art to which this disclosure pertains. In case of conflict, the patent specification, including definitions, governs. As used herein, the indefinite articles "a" and "an" mean "at least one" or "one or more" unless the context clearly dictates otherwise.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

FIG. 1 schematically depicts a safe ring, according to some embodiments of the invention;

FIGS. 2A, 2B, 2C and 2D schematically depict cross section views of various configurations of safe rings, according to some embodiments of the invention;

Figure 3:
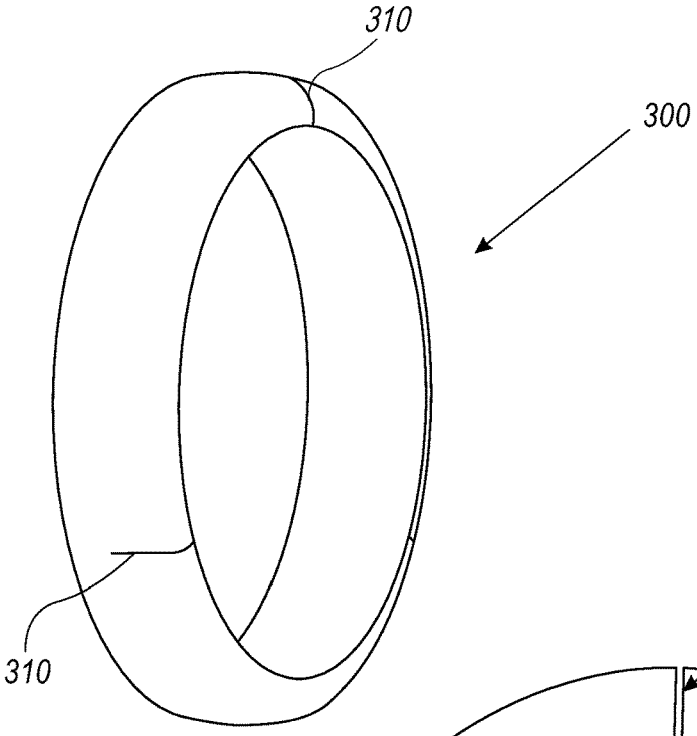
FIG. 3 schematically depicts an isometric view of a safe ring, according to some embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF EMBODIMENTS OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Some aspects of the invention may be directed to a safe ring that may easily be removed or torn form the finger, when an external pull force (e.g., of 10 Newton, 20 Newton, 30 Newton or more) may be applied on the ring. Such a ring may be removed from the finger in a harmless way. In case of an emergency when the ring is caught in a machine or have to be quickly removed, buy cutting off the ring, in an emergency situation and the like, the safe ring according to an embodiment of the invention may be torn/brake easily without harming the finger.

A ring according to some embodiments of the invention may include a primary ring having weak spots (e.g., a metallic ring) and a secondary ring being at least partially encompassed by the primary ring. In some embodiments, the secondary ring may include extendable (e.g., elastic) material and/or tearable material. In some embodiments, the circumference of the ring will expand under an application of an external pull force of at least 10 Newton.

Another ring according to some embodiments of the invention may include a single complete ring having at least one weak spot at which the ring is configured to be broken under an application of an external pull force of at least 20 Newton.

Reference is now made to FIG. 1, which schematically depicts a safe ring 100, according to some embodiments. Ring 100 may include a primary ring (e.g., an outer ring layer) 102 and a secondary ring (e.g., an inner ring layer) 104. Primary ring 102 may be made from a material having an ultimate tensile strength higher than 60 MPa, for example, metal, metal alloy, wood, ceramics, glass, resin, carbon fiber, stone, marble, and composite material.

In some embodiments, secondary ring 104 may be made of a non-allergenic material, which may include, for example, silicon. In some embodiments, secondary ring 104 may be made from a tearable material, selected such that the secondary ring is configured to be torn under the external pull force. In some embodiments, secondary ring 104 may be made from an extendable material, selected such that the secondary ring is configured to extend under an external pull force of at least 1, 2, 3, 5, 10 Newton, for example, 20, 30, 40 or more Newton.

In some embodiments, secondary ring 104 may be made from a material having at least Shore-A 60 hardness. In some embodiments, secondary ring 104 may include secondary weak spots (not illustrated) in which secondary ring 104 may be configured to be torn and/or expand and/or break under the application of the external pull force. In some embodiments, secondary ring 104 may have a separable structure, selected such that the secondary ring is configured to be separated in to two or more separate portions and/or torn under the external pull force, for example, a pull force of at least 20 Newton.

In some embodiments, the tearable material or the extendable material and/or breakable material of secondary ring 104 may include at least one of: elastomers, other polymers, a natural fabric, a synthetic fabric and silicone. In some embodiments, the tearable material or the extendable material of secondary ring 104 may be at least one of: a non-allergenic material, a heat insulating material, and an electricity insulating material.

In some embodiments, a circumference of the ring may expand under an application of an external pull force of at least 10 Newton, for example, 20, 25, 30, 35, 40 or more Newton. In some embodiments, the circumference of the ring will be torn under an application of an external pull force of at least 20 Newton, for example, 25, 30, 35, 40 or more Newton. In some embodiments, ring 100 may be configured to fully encompass a circumference of a finger In some embodiments, secondary ring 104 may have a cross section of 0.1-50 mm2, for example, 0.1-20 mm2, 0.1-10 mm2, or less.

In some embodiments, primary ring 102 may include one or more weak spots 103. As used herein, one or more weak spots 103 in primary ring 102 may be defined as areas and/or locations on the circumference of primary ring 102 that may include one or more discontinuities and/or inconsistencies in the cross-section of primary ring 102. For example, weak spots 103 may include one or more of: slots, cuts, grooves, cavities, conduits, gaps, openings, connectors, and any combination thereof. Some examples for weak spots according to some embodiments of the invention are given herein below with respect to FIGS. 3-13.

In some embodiments, the one or more weak spots may include at least two ends of the primary ring and the ring may include at least one component configured to limit relative movement of the at least two ends with respect to each other. In a nonlimiting example, the component may be secondary ring 104 may be made from a ridged material that may limit two ends of primary ring 102 (e.g., when week a spot 103 forms two ends of primary ring 102) to relatively move with respect to each other. For example, the secondary ring may be made from a material having at least Shore-A 60 hardness. In some embodiments, secondary ring 104 may limit relative movement of the at least two ends in at least two perpendicular axes. In some embodiments, secondary ring 104 may be configured to limit relative movement of the at least two ends in three perpendicular axes.

In some embodiments, primary ring 102 may have a cross section of 0.5-100 mm2. In some embodiments, the outer surface of secondary ring 104 and the inner surface of primary ring 102 are, at least partially, connected or attached to each other, e.g., by glue and/or by mechanical attachment. In some embodiments, ring 100 may be structured such that when the ring is worn, the inner surface (or part thereof) of secondary ring 104 contacts the finger, on which the ring is worn, however, primary ring 102 may not contact the finger and thus an allergic reaction is prevented.

Reference is now made to FIGS. 2A, 2B, 2C and 2D, which schematically depict cross section views of various configurations of safe rings, according to some embodiments of the invention.

In some embodiments, the primary and secondary rings may be mechanically connected. A nonlimiting example for such a mechanical connection is given in FIG. 2A which schematically depict a cross section view of a safe (e.g., bi-layer) ring 200*a* having a primary ring 202*a*, which penetrates at its edges to the edges of secondary ring 204*a*. For example, primary ring 202*a* may include a recess 206*a* configured to accommodate protrusion or bulge 208*a* of secondary ring 204*a*. This structure facilitates a connection between the two rings. An adhesive may or may not be used. If used, it may be applied to the whole surface connecting between the rings or only to parts thereof (for example, single or a few points applied with adhesive material).

FIG. 2B schematically depict a cross section view of a safe ring 200*b* having a primary ring 202*b*, which is wider than secondary ring 204*b*, i.e., having edges that extend beyond the edges of secondary ring 204*b*. In this structure an adhesive is typically applied between the layers or only to parts thereof to attach them to each other. In should be appreciated by one of ordinary skill in the art that any other method of attaching or affixing primary ring 202*b* and 204*b* may be used.

FIG. 2C schematically depict a cross section view of a safe (e.g., bi-layer) ring 200*c* having a primary ring 202*b*, having edges that extend over ("hug") the edges of secondary ring 204*c*. This structure facilitates a connection between the two rings. An adhesive may or may not be used. If used, it may be applied to the whole surface connecting between the layers or only to parts thereof (for example, single or a few points applied with adhesive material). Other methods of attaching or affixing primary ring 202*c* and 204*c* may be used.

FIG. 2D schematically depict a cross section view of a safe (e.g., bi-layer) ring 200*d* having a secondary ring 204*d*, having edges that extend over ("hug") the edges of primary ring 202*d* This structure facilitates a connection between the two rings. An adhesive may or may not be used. If used, it may be applied to the whole surface connecting between the rings or only to parts thereof (for example, single or a few points applied with adhesive material). This structure also prevents contact of the fingers adjacent to the finger on which the ring is worn, with primary ring 202*d*, and thus may prevent an allergic reaction to these fingers as well.

In some embodiments, secondary rings 204*a*-204*d* may be made from a tearable material or an extendable material. In some embodiments, secondary rings 204*a*-204*d* may be made from least one of: polymers (e.g., elastomers), a natural fabric, a synthetic fabric and silicone. In some embodiments, secondary rings 204*a*-204*d* may be at least one of: a non-allergenic material, a heat isolator, and an electric isolator.

Reference is now made to FIG. 3, which schematically depicts an isometric view of a safe ring 300 for safely wearing on a finger, according to some embodiments. Ring 300 may include a single ring/element/layer (as illustrated) or may further include another secondary ring (not illustrated). Ring 300 may be made of a material (e.g., rigid material) having an ultimate tensile strength higher than 60 MPa, such as, but not limited to, a metal, metal alloy, wood, ceramics, glass, resin, carbon fiber, stone, marble, and composite material. In some embodiments, ring 300 may include one or more weak spots (e.g., one or more cuts 310) at which the ring is configured to be broken under an application of an external pull force of at least 20 Newton (in FIG. 3 two cuts are shown, but the ring may include any number of cuts such as 3, 4, 5 or more). For example, at least one cut 310 may be a partial cut that extends from one edge of the outer surface of the ring to the other edge of the outer surface of the ring but only through part of the width of the ring, or vice versa, so that the inner surface of ring 300 remains intact or the outer surface of ring 300 remains intact. In another non limiting example, at least one cut 310 may be a partial cut that extends from one edge of the outer surface of the ring towards the other edge of the outer surface of the ring but only through part of the breadth of the ring, so that one of the edges of ring 300 remains intact, at least in the proximity of cut 310. Cut 310 may function as a "weak spot" such as a breaking point. Thus, when an external pull force, of at least 20 Newton, is applied to ring 300, the ring may be configured to bend or break and maintaining the integrity of the finger. The two sides of the cut may contact each other or may leave a gap forming a slot. The slot(s) may or may not be filled with another material, maintaining the weak spot effect. In some embodiments, ring 300 may be configured to fully encompass a circumference of the finger.

Figure 4:
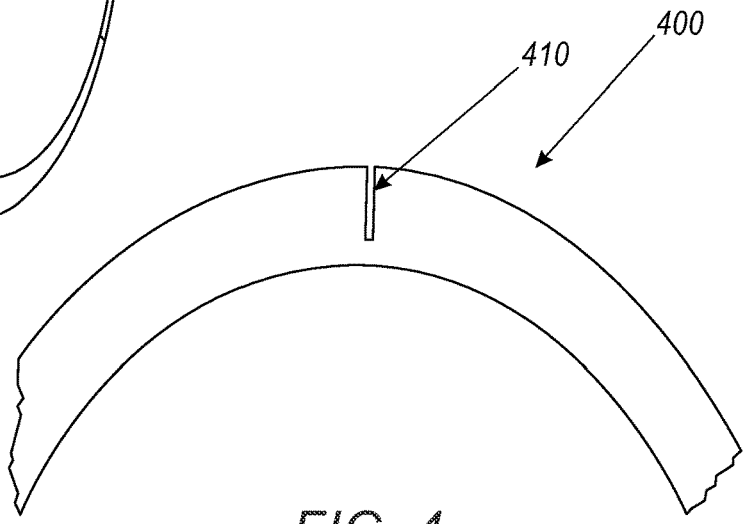
FIG. 4 schematically depicts a partial side view of a safe ring, according to some embodiments of the invention.
Figure 5A:
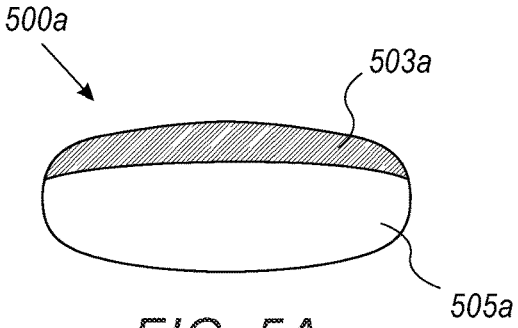
FIGS. 5A, 5B, 5C and 5D schematically depict other configurations of safe rings, according to some embodiments of the invention.
Figure 5B:
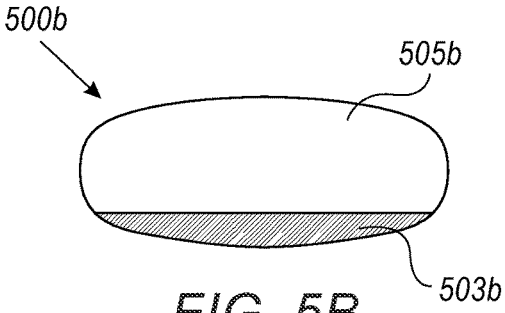
Figure 5C:
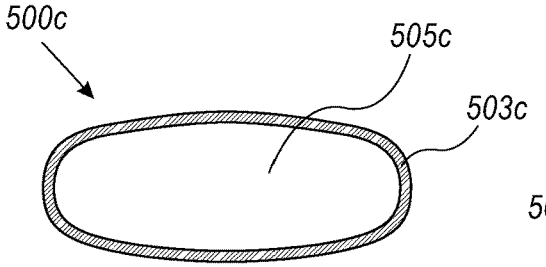
Figure 5D:
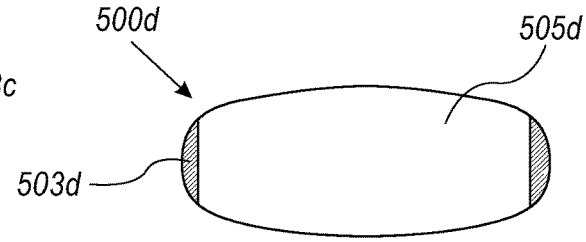

FIG. 4 schematically depicts a partial side view of a safe ring 400, for safely wearing on a finger, according to some embodiments. Ring 400 may include a single ring/element/layer (as illustrated) or may further include another secondary ring (not illustrated). Ring 400 may be made of a material (e.g., rigid material) having an ultimate tensile strength higher than 60 MPa, such as, but not limited to, a metal, metal alloy, wood, ceramics, glass, resin, carbon fiber, stone, marble, and composite material. In some embodiments, ring 400 may include one or more weak spots such as cut 410. Cut 410 may be a partial cut that extends from one edge of the outer surface of the ring to the other edge of the outer surface of the ring but only through part of the width of the ring such that the inner surface of ring 400 may remain intact. Cut 410 may functions as a weak spot. Thus, when an external pull force is applied to ring 400, the ring is configured to bend or break and maintaining the integrity of the finger. The two sides of the cut may contact each other or may leave a gap forming a slot. In some embodiments, ring 400 may be configured to fully encompass a circumference of the finger.

In some embodiments, weak spots 310 and/or 410 of rings 300 and/or 400 may have a cross section smaller in at least one dimension, than cross sections in other portions of rings 300 and 400. In some embodiments, weak spots 310 and/or 410 of rings 300 and/or 400 may include one or more of: slots, cuts, grooves, cavities, conduits, gaps openings and any combination thereof. The slot(s) may or may not be filled with another material, maintaining the "weak spot.

In some embodiments, rings 300 and/or 400 may include at least two portions made from at least two different materials such that a connection area between each two portions creates a weak spot 310 and/or 410. In some embodiments, rings 300 and/or 400 may include two or more separate sections such that each weak spot 310 and/or 410 may be defined by a contact surface between two separate sections.

Reference is now made to FIGS. 5A-5D, which schematically depict cross-section views of additional/alternative configuration of safe rings 500*a*, 500*b*, 500*c* and 500*d*, according to some embodiments. Each one of safe rings 500*a*, 500*b*, 500*c* and 500*d*, may include primary ring 503*a*, 503*b*, 503*c* and 503*d*, respectively made from a material having an ultimate tensile strength higher than 60 MPa (e.g., metal, metal alloy, etc.). Primary rings 503*a*, 503*b*, 503*c* and 503*d* may have one or more weak spots having cross section smaller in at least one dimension, than cross sections in other portions of primary rings 503*a*, 503*b*, 503*c* and 503*d*, depicted as weak spots 505*a*, 505*b*, 505*c* and 505*d*, respectively. The weak spots may include, voids, conduits, holes, etc. or may be filled with some material other than the material of primary ring 503*a*, 503*b*, 503*c* and 503*d*. Thus, when an external pull force, of at least 20 Newton, is applied to ring 500, the ring is configured to bend or break while maintaining the integrity of the finger. When the external pull force is applied to safe rings 500*a*, 500*b*, 500*c* and 500*d*, the rings may be configured to the respective bend or break (due to the respective weak spots 505*a*, 505*b*, 505*c* and 505*d*) while maintaining the integrity of the finger.

In some embodiments, rings 300 and/or 400 may include at least two portions made from the same material. In some embodiments, the one or more weak spots may be defined by connection areas. As used herein, a connection area weak spot may be defined as a location along the ring (e.g., the primary ring) defined by a complete separation between two ends of the ring which is either filled with an additional material or connected by support provided by the secondary ring, configured to connect two free end of the ring and/or bridge the gap between the two free ends. The gap may have any width.

Figure 6:
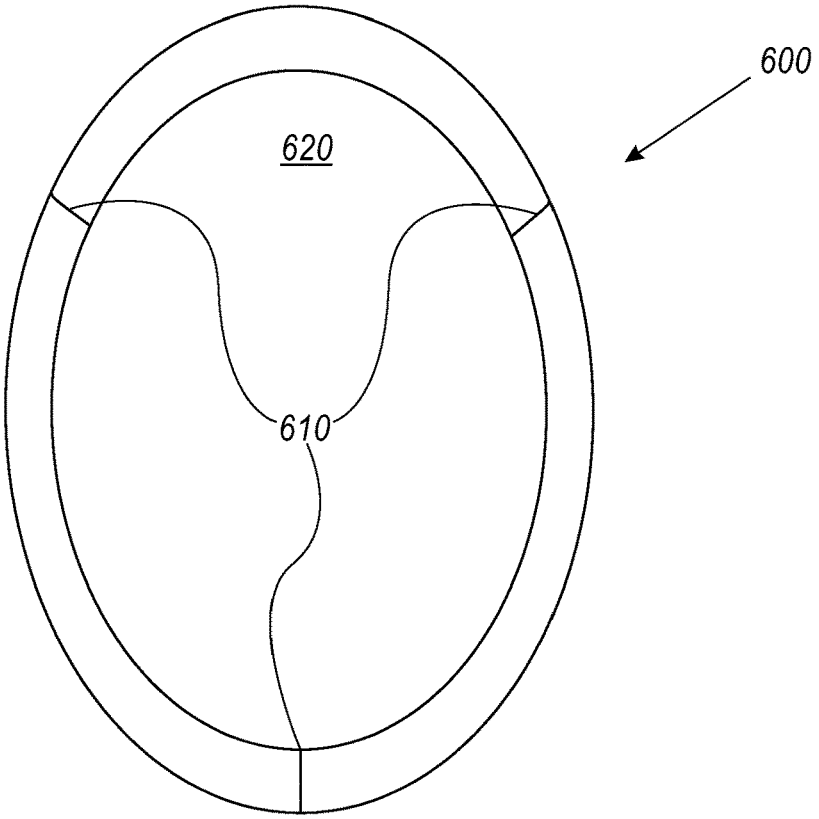
FIG. 6 schematically depicts a side view of a safe ring, according to some embodiments of the invention.

Reference is now made to FIG. 6, which schematically depicts a side view of a safe ring 600 for safely wearing on a finger, according to some embodiments. Ring 600 may include a single ring/element/layer (as illustrated) or may further include another secondary ring (not illustrated). Ring 600 may be made of a material having an ultimate tensile strength higher than 60 MPa (e.g., metal, metal alloy, etc.), and may include one or more weak spots (e.g., cuts) 610 (in this figure three cuts are shown, but the ring may include one, two, three or more cuts). Cuts 610 are shown to be full cuts, forming three separate sections 620, that extend all the way from one edge of the outer surface of the ring to the other edge of the outer surface of the ring. Cuts 610 thereby may form three separate ring sections 620. It is noted, however, that the cuts (or some of the cuts) can also be partial cuts that extend from one edge of the outer surface of the ring to the other edge of the outer surface of the ring but only through part of the width of the ring, or from one edge towards the other edge but only through part of the breadth of the ring. Cuts 610 may be filled with a material (e.g., adhesive material) being weaker than the material of the ring (e.g., metal). Therefore, when an external pull force, of at least 20 Newton, is applied to ring 600, a circumference the ring is configured to expand. As used herein expending the circumference of the ring includes at least one of the following events, stretching, bending, tearing, and/or breaking of at least the primary ring and the secondary ring, for example, at the weak spots while maintaining the integrity of the finger.

In some embodiments, rings 300, 400, 500*a*-500*d* and 600 may have a cross section of 0.5-100 mm2. In some embodiments, rings 300, 400, 500*a*-500*d* and 600 may be made from at least one of, a metal, metal alloy, wood, ceramics, glass, resin, carbon fiber, stone, marble, and composite material.

In some embodiments, rings 300, 400, 500*a*-500*d* and 600 may be the primary ring (e.g., primary ring 102) when included in a ring such as rings 100 and 200*a*-200*d*. In such case in addition to primary rings 300, 400, 500*a*-500*d* and 600 the ring may include a secondary ring, for example, secondary rings 104 and 204*a*-204*d*.

Figure 7:
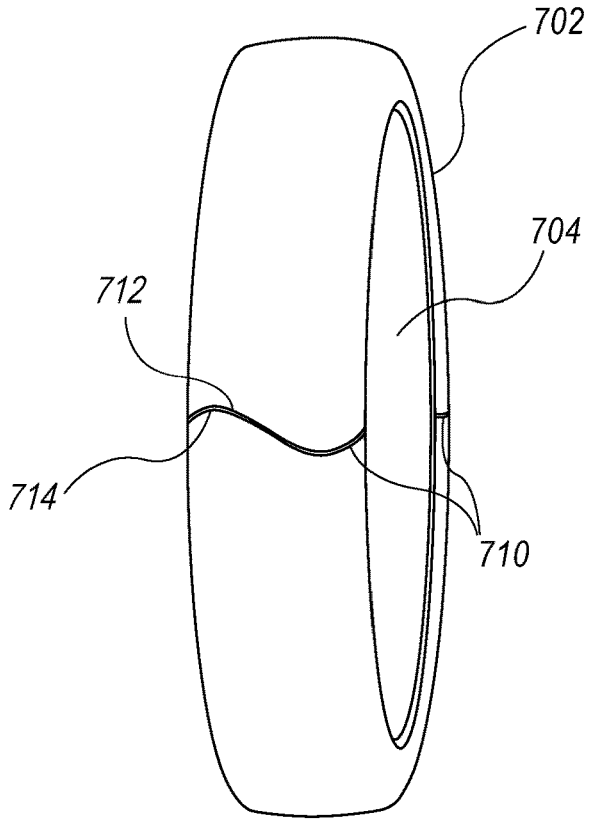
FIG. 7 schematically depicts a configuration of a safe ring, according to some embodiments of the invention.

Reference is now made to FIG. 7, which schematically depicts a configuration of a safe ring 700, according to some embodiments. Ring 700 may include a primary ring 702 and a secondary ring 704. Primary ring 702 may be made of a material having an ultimate tensile strength higher than 60 MPa, such as for example, a metal, metal alloy, wood, ceramics, glass, resin, carbon fiber, stone, marble, and composite material. Secondary ring 704 may be made of, extendable (e.g., by at least 50% following applying pull force of at least 10 N), breakable (e.g., by applying pull force of at least 20 N), tearable (e.g., by applying pull force of at least 20 N), soft or flexible material (e.g., having a module of elasticity of about 3 MPa). For example, Secondary ring 704 may be made of: polymers (e.g., elastomers), a natural fabric, a synthetic fabric and silicone. In accordance with additional or alternative embodiments, secondary ring 704 may be made of a non-allergenic material, a heat insulator, and/or an electricity insulator, for example, various elastomers, other polymers, silicone, cotton fabrics, etc. The outer surface of secondary ring 704 and the inner surface of Primary ring 702 may be at least partially connected or attached to each other, e.g., by glue or by mechanical attachment. It should be appreciated by those skilled in the art that any other means for attaching or affixing primary and secondary rings to each other may be used.

In some embodiments, primary ring 702 may be an open ring having at least two free ends 712 and 714, having a gap or a cut 710 between at least two free ends 712 and 714. Gap 710 may define a weak spot. In this figure, Gap(s) 710 extends from one edge of primary ring 702 to the other edge of primary ring 702. Gap 710 is shown in this figure as a curved line, but it can also be straight, diagonal, zig zag etc.

Gap(s) 710 may be complete cuts, i.e., extending throughout the entire cross-section of primary ring 702, thus forming separate sections in primary ring 702. Gap(s) 710 may also be partial cuts, i.e., extending only through a part of the width or breadth of primary ring 702, so that, for example, the inner surface of primary ring layer 702 may remain intact. In some embodiments, when an external pull force, of at least 20 Newton, is applied to ring 700, the circumference of primary ring 702 may be configured to expand and/or primary ring 702 may be configured to bend or break, thus maintaining the integrity of the finger. When the external pull force is applied to ring 700, secondary ring 704 may stretch, expend but remains intact or open-up or may be torn/broken. Gap 710 may have any width, for example, 0.1 micron-5 mm.

Gaps(s)/slot(s) 710 may or may not be filled with another material.

It is noted that although FIG. 7 shows ring 700 having secondary ring 704, the scope of this disclosure also covers a ring similar to ring 700 but without secondary ring 704 (e.g., only with primary ring 702).

Reference is now made to FIGS. 8A-8K, which schematically depict other configuration of a safe ring, according to some embodiments.

Figure 8A:
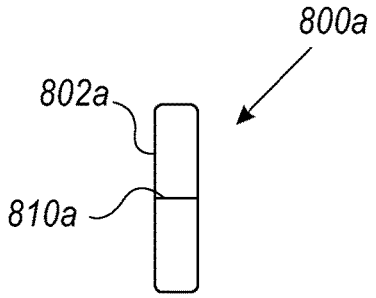
FIGS. 8A, 8B, 8C, 8D, 8E, 8F, 8G, 8H, 8I, 8J and 8K schematically depict other configurations of a safe ring from different full or partial views, according to some embodiments of the invention.

FIG. 8A schematically depicts a front view of a safe ring 800*a* having a primary ring 802*a*, and at least one straight cut 810*a*, defining a weak spot, extending from one edge of primary ring 802*a* to the other edge thereof. Safe ring 800*a* may also include a secondary ring layer (not shown).

Figure 8B:
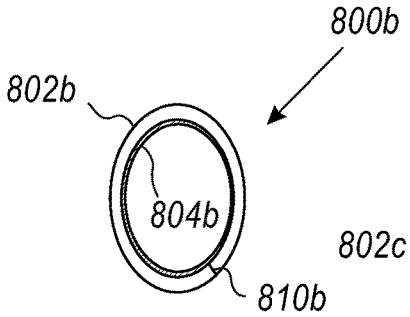

FIG. 8B schematically depicts a side view of a safe ring 800*b* having a primary ring 802*b*, a secondary ring 804*b* and a complete cut 810*b*, defining a weak spot, extending throughout the entire thickness of primary ring 802*b*. Cut 810*b* functions as a "weak spot"/breaking point.

Figure 8C:
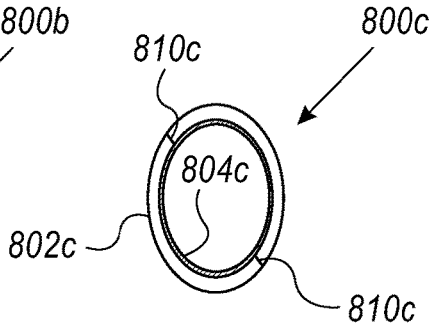

FIG. 8C schematically depicts a side view of a safe ring 800*c* having a primary ring 802*c*, a secondary ring 804*c* and two complete cuts 810*c*, defining weak spots, extending throughout the entire thickness of primary ring 802*c*. Cuts 810*c* function as a "weak spots"/breaking points.

Figure 8D:
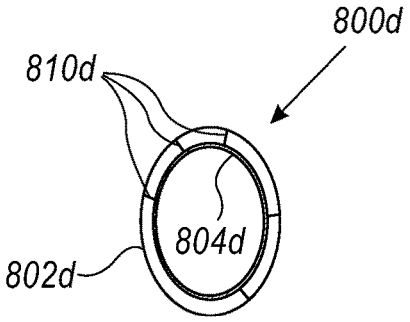

FIG. 8D schematically depicts a side view of a safe ring 800*d* having a primary ring 802*d*, a secondary ring 804*d* and multiple complete cuts 810*d*, defining weak spots, extending throughout the entire thickness of primary ring 802*d*.

Figure 8E:
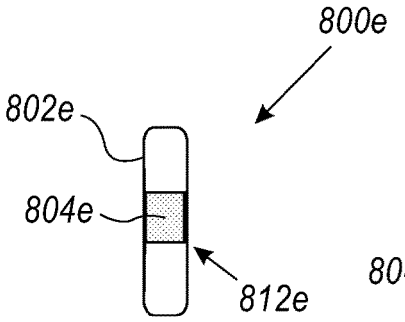

FIG. 8E schematically depicts a front view of a safe ring 800*e* having a non-fully closed primary ring 802*e*, a secondary ring 804*e* and an opening/"missing" section 812*e* in primary ring layer 802*e*.

Figure 8F:
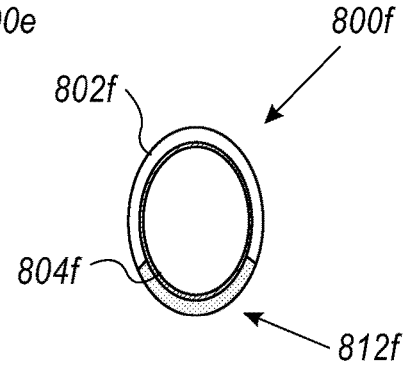

FIG. 8F schematically depicts a side view of a safe ring 800*f* having a non-fully closed primary ring 802*f*, an inner ring layer 804*f* and opening 812*f* in primary ring 802*f* Opening 812*f*, defining a weak spots which in FIG. 8F is illustrated as about one third of the ring circumference, can be of any size up to e.g., 60% of the ring circumference, for example, 5%, 10%, 25%, 33%, 40% or any other size between 1-60% of the ring circumference.

Figure 8G:
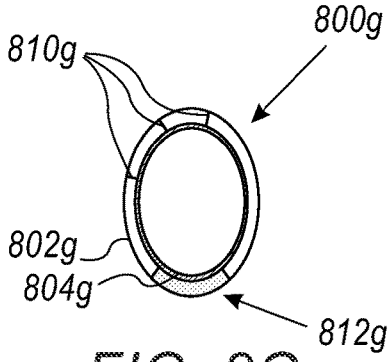

FIG. 8G schematically depicts a side view of a safe ring 800*g* having a non-fully closed primary ring 802*g*, a secondary ring 804*g*, multiple complete cuts 810*g* extending throughout the entire thickness of primary ring 802*g* and an opening section 812*g* in primary ring 802*g*. Cuts 810*g* and opening 812*g* may define weak spots.

Figure 8H:
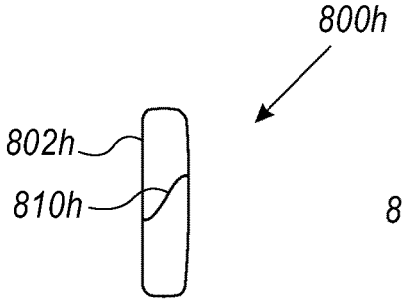

FIG. 8H schematically depicts a front view of a safe ring 800*h* having a primary ring 802*h*, and a curved cut 810*h* extending from one edge of primary ring layer 802*h* to the other edge thereof. Cut 810*h* may be or may define a weak spot. Safety ring 800*h* may also include a secondary ring (not shown).

Figure 8I:
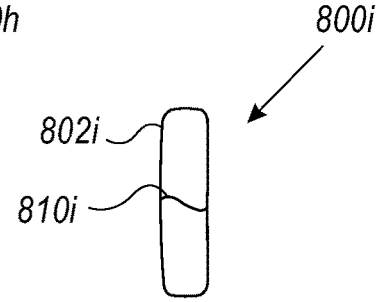

FIG. 8I schematically depicts a front view of a safe ring 800*i* having a primary ring 802*i*, and a slightly curved cut 810*i* extending from one edge of primary ring 802*i* to the other edge thereof. Cut 810*i* may define a weak spot. Safe ring 800*i* may also include a secondary ring (not shown).

Figure 8J:
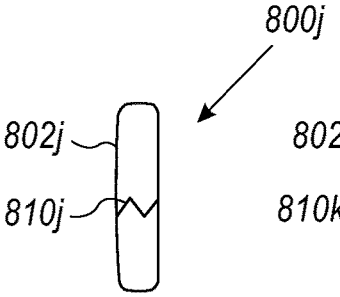

FIG. 8J schematically depicts a front view of a safe ring 800*j* having a primary ring 802*j*, and a zig zag shaped cut 810*j* extending from one edge of primary ring 802*j* to the other edge thereof. Cut 810*j* may define a weak spot. Safe ring 800*j* may also include an inner ring layer (not shown).

Figure 8K:
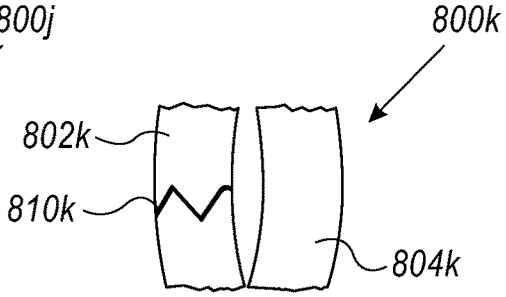

FIG. 8K schematically depicts a partial isometric view of a safe ring 800*k* having a primary ring 802*k*, an inner ring layer 804*k* and a zig zag shaped complete cut 810*k* extending from one edge of primary ring 802*k* to the other edge thereof and throughout the entire thickness of primary ring 802*k*. Cut 810*k* may be defined as a weak spot. Safe ring 800*k* may also be devoid of an inner ring.

It is noted that even though in some of the figures only one weak spot is shown, the scope of this disclosure covers, in accordance with some embodiments, a plurality (2, 3, 4, 5, or more) weak spots. It should be further noted that while specific types of weak spots are illustrated in the Figures, other types of weak spots are also covered by the disclosure, such as groves, slots, conduits, etc. and the opening and cuts illustrated in to FIGS. 8A-8K, are given as a nonlimiting examples only.

Figure 9:
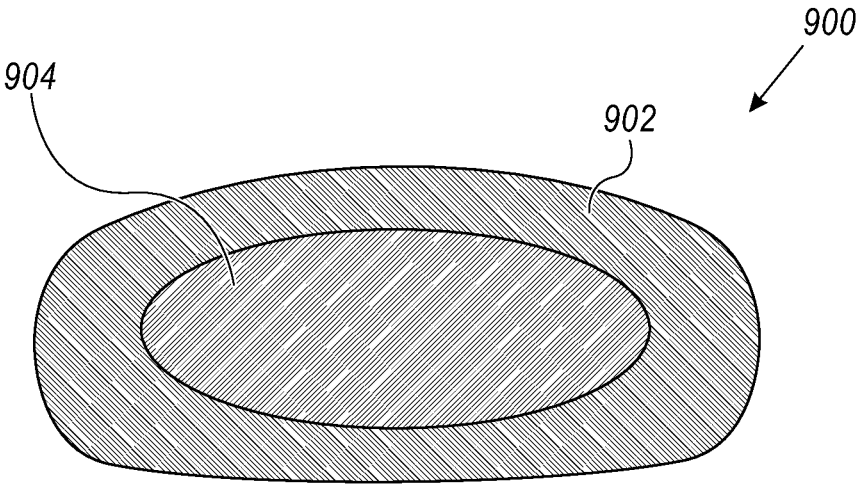
FIG. 9 schematically depicts a cross-section of a safe ring, according to some embodiments of the invention.

Reference is now made to FIG. 9, which schematically depicts a cross-section view of a safe ring 900, according to some embodiments. Safe ring 900 includes a primary ring 902 (made of material having an ultimate tensile strength higher than 60 MPa, such as metal) and a secondary ring 904 (made of extendable and/or tearable material, such as silicon). In some embodiments, secondary ring 904 is completely enclosed within or encompass by primary ring 902. Primary ring 902 may include one or more weak spots along the circumference thereof. Thus, when an external pull force, of at least 20 Newton is applied to ring 900, primary ring 902 may be configured to bend or break while maintaining the integrity of the finger and inner ring layer 904 may stretch, remains intact, open up or may be torn or broken.

Figure 10:
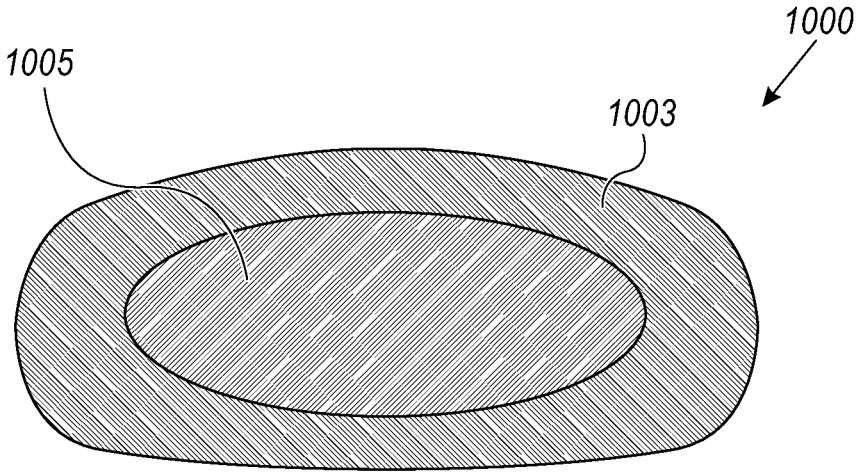
FIG. 10 schematically depicts a cross-section of a safe ring, according to some embodiments of the invention.

Reference is now made to FIG. 10, which schematically depicts a cross-section of another type of safe ring 1000, according to some embodiments. As opposed to FIG. 9, in safe ring 1000, primary ring 1005 made of material having an ultimate tensile strength higher than 60 MPa, such as metal is encompassed by secondary ring 1003 which is made of extendable and/or tearable material, such as silicon. In such ring, primary ring 1005 includes one or more weak spots (e.g., cuts, grooves, or spaces) along the circumference thereof. Thus, when an external pull force, of at least 20 Newton, is applied to ring 1000, the circumference of primary ring 1005 may be configured to expand while maintaining the integrity of the finger, and secondary ring 1003 may stretch, remains intact, or may be torn/broken.

In some embodiments, the one or more weak spots may include at least two ends of the primary ring and the ring may include at least one component configured to limit relative movement of the at least two ends with respect to each other. In some embodiments, the at least one component is one or more connectors configured to connect at least two ends of the primary ring. Some nonlimiting examples for such connectors (e.g., components) are illustrated and discussed with respect to FIGS. 11-13.

Figure 11A:
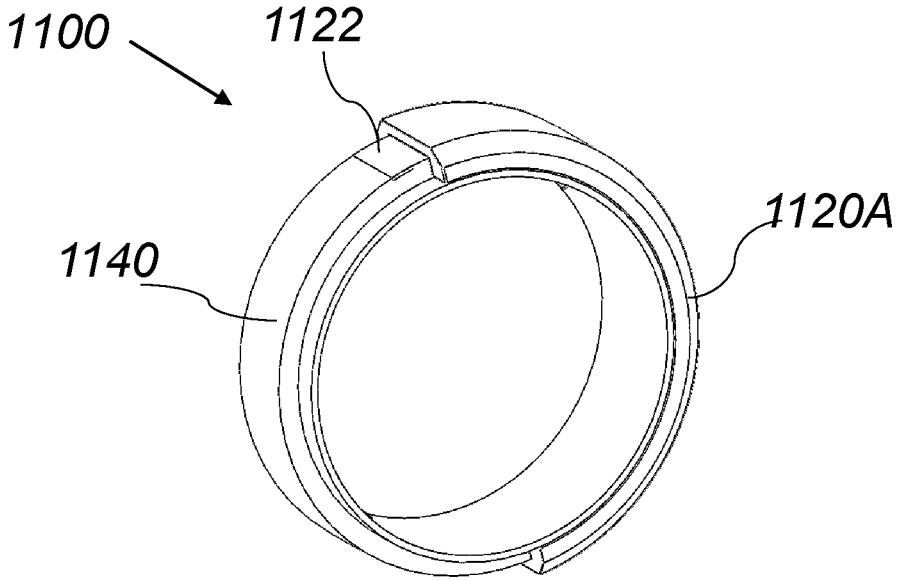
FIGS. 11A and 11B schematically depict another configuration of a safe ring and a primary ring, according to some embodiments of the invention.
Figure 11B:
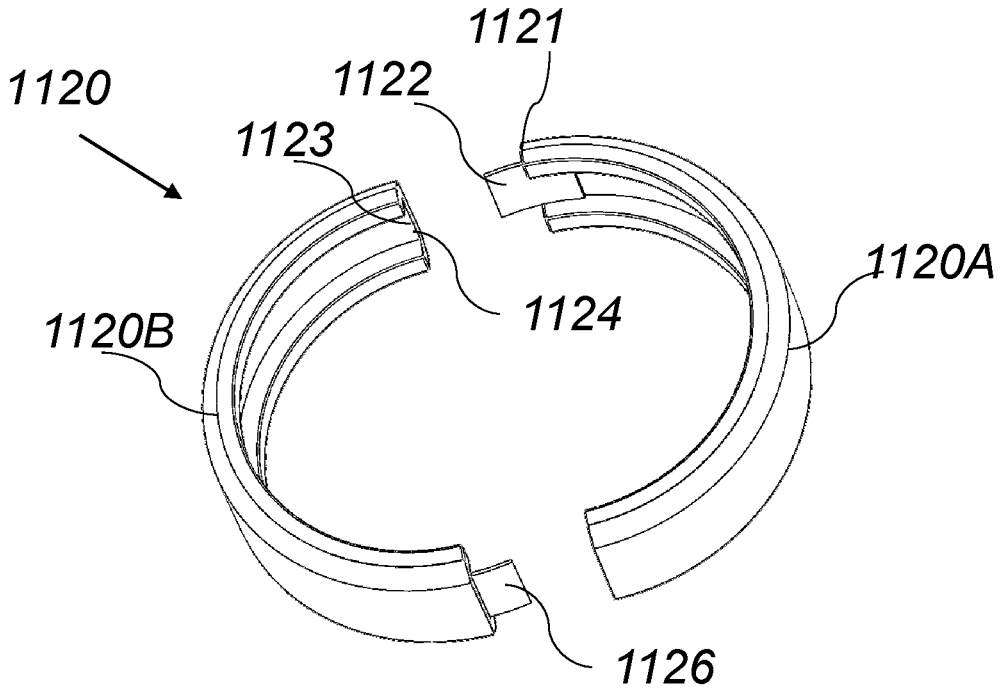

Reference is now made to FIGS. 11A and 11B which schematically depict a safe ring and a primary ring, respectively, according to some embodiments of the invention. A safe ring 1100 may include a primary ring 1120, made from a material having an ultimate tensile strength higher than 60 MPa. In some embodiments, primary ring 1120 may include one or more weak spots that may include one or more connectors 1122 configured to connect at least two ends 1121 and 1123 of primary ring 1120 to limit a relative movement of at least two ends 1121 and 1123 with respect to each other. As used herein, limit relative movement is by up to 1 mm in each direction. In some embodiments, primary ring 1120 may include two or more portions 1120A and 1120B and connectors 1122 may be configured to connect portion 1120A to portion 1120B, such that there is no relative movement between the two portions.

In the nonlimiting example illustrated in FIGS. 11A and 11B two connectors 1122 may include a tongue of a lock 1124 configured to be inserted (e.g., clicked) into at least one recess 1126 in order to close primary ring 1120 into a full ring. The tongue of a lock/recess mechanism of connector 1122 may limit relative movement (e.g., bidirectional movement) of at least two ends 1121 and 1123 with respect to each other. In some embodiments, tongue of a lock 1124 may be connected to end 1121 of primary ring 1120, as illustrated. In some embodiments, tongue of a lock 1124 may be connected (e.g., glued, partially embedded, etc.) in a secondary ring 1140. In some embodiments, tongue of a lock 1124 may be a separate element configured to be inserted into two corresponding recesses in two ends 1121 and 1123 of primary ring 1120. In some embodiments, one or more connectors 1122 may be configured to limit relative movement (e.g., bidirectional movement) of at least two ends 1121 and 1123 in at least two perpendicular axes. In some embodiments, one or more connectors 1122 may be configured to limit relative movement (e.g., bidirectional movement) of at least two ends 1121 and 1123 in three perpendicular axes.

In some embodiments, safe ring 1100 may further include a secondary ring 1140 encompassed by primary ring 1120. Secondary ring 1140 may include or may be made from any material discussed herein above. In some embodiments, the circumference of ring 1100 may be configured to expand under an application of an external pull force. In some embodiments, under the application the pull force, secondary ring 1140 may be configured to extend/torn and tongue of a lock 1124 may disconnect from recess 1126.

Figure 12A:
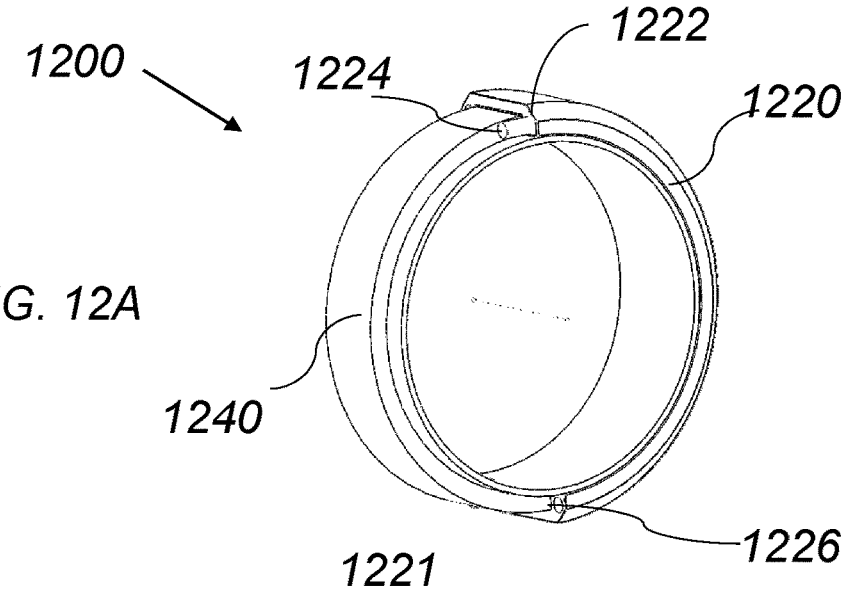
FIGS. 12A and 12B schematically depict another configuration of a safe ring and a portion of a primary ring, according to some embodiments of the invention.
Figure 12B:
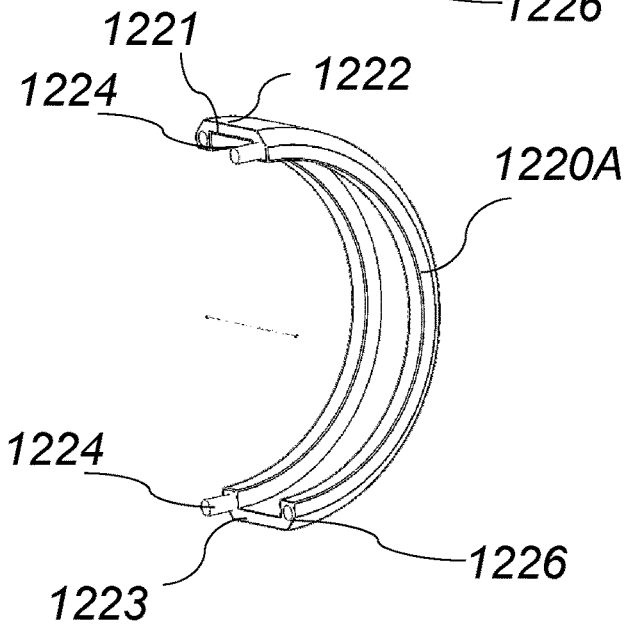

Reference is now made to FIGS. 12A and 12B which schematically depict a safe ring and a portion of a primary ring, respectively, according to some embodiments of the invention. A safe ring 1200 may include a primary ring 1220, made from a material having an ultimate tensile strength higher than 60 MPa. In some embodiments, primary ring 1220 may include one or more weak spots that may include one or more connectors 1222 configured to connect at least two end types 1221 and 1223 of primary ring 1220 to limit a relative movement of at least two ends 1221 and 1223 with respect to each other. In some embodiments, primary ring 1220 may include two or more portions, and connectors 1222 may be configured to connect a first portion 1220A to a second portion, not illustrated, such that there is no relative movement between the two portions.

In FIGS. 12A and 12B only one portion 1220A (e.g., half) of primary ring 1220 is illustrated, therefore, two end types of primary ring 1220 are shown on a single portion. When primary ring 1220 includes only one portion, ends 1221 and 1223 define two ends of one portion and configured to be attached to each other. When primary ring 1220 includes two or more portions the illustrated two ends are configured to attached to ends of the other portion.

In the nonlimiting example illustrated in FIGS. 12A and 12B two connectors 1222 may include a projection 1224 and hole 1226, such that when connected together, projection 1224 may be inserted into hole 1226.

In some embodiments, one or more connectors 1222 may be configured to limit relative movement (e.g., bidirectional movement) of at least two ends 1221 and 1223 in at least two perpendicular axes, for example, in three perpendicular axes.

In some embodiments, safe ring 1200 may further include a secondary ring 1240 encompassed by primary ring 1220. Secondary ring 1240 may include or may be made from any material discussed herein above. In some embodiments, the circumference of ring 1200 may be configured to expand under an application of an external pull force. In some embodiments, under the application the pull force, secondary ring 1240 may be configured to extend/torn and projection 1224 may disconnect from hole 1226.

Figure 13:
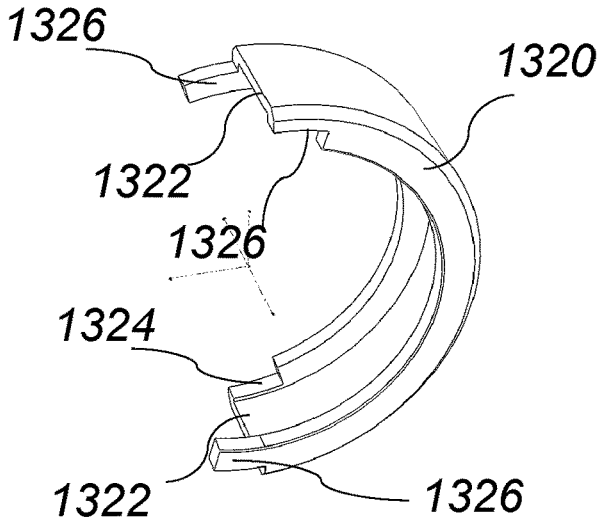
FIG. 13 schematically depicts a portion of a primary ring, according to some embodiments of the invention.

Reference is now made to FIG. 13 which schematically depict a portion of a primary ring according to some embodiments of the invention. One or more portions 1320 may form a primary ring when connected via one or more connectors 1322. Portions 1320 may be included in any one or the rings disclosed herein above, for example, portions 1320 may replace portions 1120A and 1120B of ring 1100 or the portions of ring 1200.

In the nonlimiting example illustrated in FIG. 13 each one of one or more connectors 1322 may include a projection 1324 and recess 1326 in the outer portion the primary ring, such that when connected together, projection 1324 may be inserted into recess 1326. In the description and claims of the application, the words "include" and "have", and forms thereof, are not limited to members in a list with which the words may be associated.

As used herein, the term "about" may be used to specify a value of a quantity or parameter (e.g. the length of an element) to within a continuous range of values in the neighborhood of (and including) a given (stated) value. According to some embodiments, "about" may specify the value of a parameter to be between 80% and 120% of the given value. For example, the statement "the length of the element is equal to about 1 m" is equivalent to the statement "the length of the element is between 0.8 m and 1.2 m". According to some embodiments, "about" may specify the value of a parameter to be between 90% and 110% of the given value. According to some embodiments, "about" may specify the value of a parameter to be between 95% and 105% of the given value.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable sub-combination or as suitable in any other described embodiment of the disclosure. No feature described in the context of an embodiment is to be considered an essential feature of that embodiment, unless explicitly specified as such.

The invention claimed is:

1. A safe ring comprising:

a primary ring, made from a material having an ultimate tensile strength higher than 60 MPa, the primary ring having one or more weak spots; and a secondary ring being at least partially encompassed by the primary ring, wherein a circumference of the ring is configured to expand under an application of an external pull force, wherein the primary ring is one of: extending over edges of the secondary ring and mechanically connected to the secondary ring.

2. The ring of claim 1, wherein the secondary ring is made from a tearable material, selected such that the secondary ring is configured to be torn under an external pull force of at least 20 Newton.

3. The ring of claim 2, wherein the tearable material comprises at least one of: a polymer, a natural fabric, a synthetic fabric, wood, and silicone.

4. The ring of claim 2, wherein the tearable material is at least one of: a non-allergenic material, a heat insulating material, and an electricity insulating material.

5. The ring of claim 1, wherein the secondary ring comprises one or more weak spots that are configured to be torn under the external pull force.

6. The ring of claim 1, wherein the secondary ring is made from an extendable material, selected such that the secondary ring is configured to extend under an external pull force of at least 10 Newton.

7. The ring of claim 6, wherein the extendable material comprises at least one of: elastomers, a natural fabric, a synthetic fabric and silicone.

8. The ring of claim 6, wherein the extendable material is a at least one of: a non-allergenic material, a heat insulating material, and an electricity insulating material.

9. The ring of claim 1, wherein the secondary ring is configured to encompass at least a portion of a circumference of a finger.

10. The ring of claim 1, wherein the secondary ring is one of: extending over edges of the primary ring and fully coating the primary ring.

11. The ring of claim 1, wherein the one or more weak spots include at least two ends of the primary ring and the ring includes at least one component configured to limit relative movement of the at least two ends with respect to each other.

12. The ring of claim 11, wherein the at least one component is one or more connectors configured to limit the relative movement of the at least two ends with respect to each other.

13. The ring of claim 12, wherein the one or more connectors are configured to limit relative movement of the at least two ends in at least two perpendicular axes.

14. The ring of claim 13, wherein the one or more connectors are configured to limit relative movement of the at least two ends in three perpendicular axes.

15. The ring of claim 11, wherein the at least one component is the secondary ring made from a material having at least Shore-A 60 hardness.

16. The ring of claim 1, wherein the one or more weak spots have a cross section smaller in at least one dimension, than cross sections in other portions of the primary ring.

17. The ring of claim 1, wherein the primary ring comprises at least two portions made from at least two different materials and wherein a connection area between each two portions creates a weak spot.

18. The ring of claim 1, wherein the one or more weak spots comprises one or more of: slots, cuts, grooves, cavities, conduits, gaps, connections, connection areas, openings and any combination thereof.

19. The ring of claim 1, wherein the primary ring material comprises at least one of, a metal, metal alloy, wood, ceramics, glass, resin, carbon fiber, stone, marble, and composite material.

20. The ring of claim 1, wherein the primary ring has a cross section of 0.5-100 $mm^2$.

21. The ring of claim 1, wherein the secondary ring is a full ring.

22. The ring of claim 1, wherein the primary ring comprises at least two portions.

* * * * *